US009312653B2

(12) United States Patent
Byrne et al.

(10) Patent No.: US 9,312,653 B2
(45) Date of Patent: Apr. 12, 2016

(54) ROTATABLE POWER CENTER FOR A WORK SURFACE

(71) Applicants: Norman R. Byrne, Ada, MI (US); Marc A. Mitchell, Belmont, MI (US); Randell E. Pate, Jenison, MI (US)

(72) Inventors: Norman R. Byrne, Ada, MI (US); Marc A. Mitchell, Belmont, MI (US); Randell E. Pate, Jenison, MI (US)

( * ) Notice: Subject to any disclaimer, the term of this patent is extended or adjusted under 35 U.S.C. 154(b) by 0 days.

(21) Appl. No.: 14/686,884

(22) Filed: Apr. 15, 2015

(65) Prior Publication Data

US 2015/0295375 A1 Oct. 15, 2015

Related U.S. Application Data

(60) Provisional application No. 61/980,041, filed on Apr. 15, 2014.

(51) Int. Cl.
*H01R 13/44* (2006.01)
*H01R 35/04* (2006.01)
*H01R 27/02* (2006.01)

(52) U.S. Cl.
CPC ..... *H01R 35/04* (2013.01); *H01R 13/44* (2013.01); *H01R 27/02* (2013.01)

(58) Field of Classification Search
CPC ..... H01R 35/04
USPC ..... 439/131, 534
See application file for complete search history.

(56) References Cited

U.S. PATENT DOCUMENTS 3,622,684 A 11/1971 Press
5,144,290 A * 9/1992 Honda ..... G06F 1/1616 16/306
5,276,279 A 1/1994 Brownlie et al.
5,545,848 A 8/1996 Lin
5,709,156 A 1/1998 Gevaert et al.
5,967,836 A 10/1999 Bailey
6,028,267 A * 2/2000 Byrne ..... H01R 13/518 174/55
6,185,103 B1 * 2/2001 Yamada ..... G11B 33/124 292/300
6,338,301 B1 1/2002 Almond
6,435,729 B1 8/2002 Thevenod et al.
6,518,500 B1 2/2003 Huang
6,548,755 B2 4/2003 Wu
6,695,643 B2 2/2004 Wu
6,743,978 B2 6/2004 Wu (Continued)

FOREIGN PATENT DOCUMENTS

JP 6-30515 2/1994
JP 6-30516 2/1994

(Continued)

*Primary Examiner* — Neil Abrams
(74) *Attorney, Agent, or Firm* — Gardner, Linn, Burkhart & Flory, LLP

(57) ABSTRACT

A rotatable power center is configured for installation along a work surface or the like, and includes an outer housing and a pivotable inner housing having one or more electrical or data outlets. The inner housing is positionable between a use position in which the outlets are accessible along the work surface, and a non-use position in which the outlets are generally not accessible. The outer housing defines an upper opening through which different surfaces of the inner housing are exposed or accessible, depending on the inner housing position. Spindles or spindle caps are used to pivotable mount the inner housing to the outer housing, and may also serve to secure two inner housing pieces together. A separate latch may be provided to secure the inner housing at the use or non-use position. Optionally, a detent arrangement holds the inner housing at the use or non-use position.

20 Claims, 12 Drawing Sheets

(56) References Cited

U.S. PATENT DOCUMENTS

| | | | | |
|---|---|---|---|---|
| 6,768,054 | B2 | 7/2004 | Sato et al. | |
| 6,969,800 | B1 | 11/2005 | Liao | |
| 6,979,209 | B2 | 12/2005 | Griepentrog | |
| 6,999,695 | B2 * | 2/2006 | Ueda | G03G 15/80 399/90 |
| 7,109,417 | B1 | 9/2006 | Beam | |
| 7,296,775 | B2 * | 11/2007 | Mayer | H01R 25/006 211/163 |
| 7,364,443 | B1 * | 4/2008 | McGinnis | H01R 35/02 439/131 |
| 7,407,392 | B2 * | 8/2008 | Cooke | A47B 21/06 108/62 |
| 7,445,513 | B1 | 11/2008 | Lee | |
| 7,621,764 | B2 | 11/2009 | Shunjie | |
| 7,679,901 | B2 * | 3/2010 | Lin | G06F 1/1616 312/223.1 |
| 7,999,419 | B2 * | 8/2011 | Drane | H01H 3/161 307/326 |
| 8,007,295 | B2 * | 8/2011 | Lin | A47B 21/06 439/131 |
| 8,021,172 | B2 | 9/2011 | Shunjie | |
| 8,277,233 | B2 | 10/2012 | Su | |
| 8,323,040 | B2 * | 12/2012 | Prest | H01R 13/44 439/131 |
| 8,690,590 | B2 * | 4/2014 | Byrne | H05K 5/03 439/131 |
| 8,784,130 | B2 * | 7/2014 | Scott | H01R 33/945 439/517 |
| 8,854,828 | B2 * | 10/2014 | Fan | G06F 1/1656 361/679.28 |
| 8,986,022 | B2 * | 3/2015 | Dinh | H01R 13/5213 439/131 |
| 9,019,721 | B2 * | 4/2015 | Chen | H05K 7/1427 361/810 |
| 9,110,102 | B2 * | 8/2015 | Kesler | G01R 1/206 |
| 2007/0064096 | A1 | 3/2007 | Beam | |
| 2008/0123894 | A1 * | 5/2008 | Lu | H04R 1/403 381/394 |
| 2010/0124849 | A1 * | 5/2010 | Winstanley | H01R 13/44 439/620.21 |
| 2013/0027856 | A1 * | 1/2013 | Tai | F16M 11/041 361/679.01 |
| 2015/0295375 | A1 * | 10/2015 | Byrne | H01R 35/04 439/131 |

FOREIGN PATENT DOCUMENTS

| | | |
|---|---|---|
| JP | 6-30517 | 2/1994 |
| JP | 6-98442 | 4/1994 |

* cited by examiner

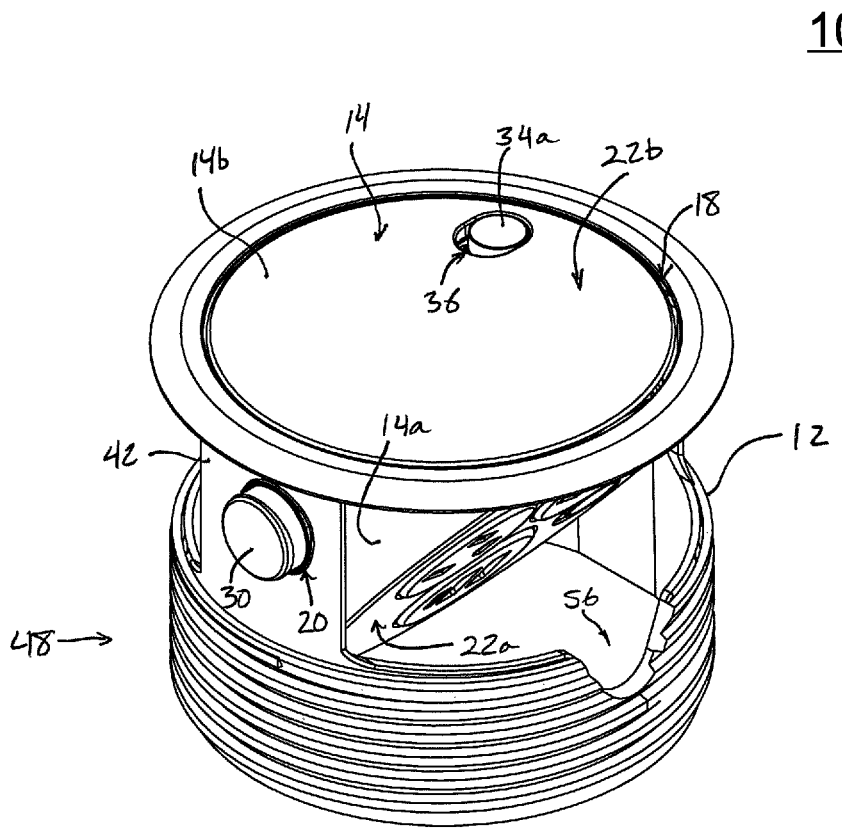
Fig. 1
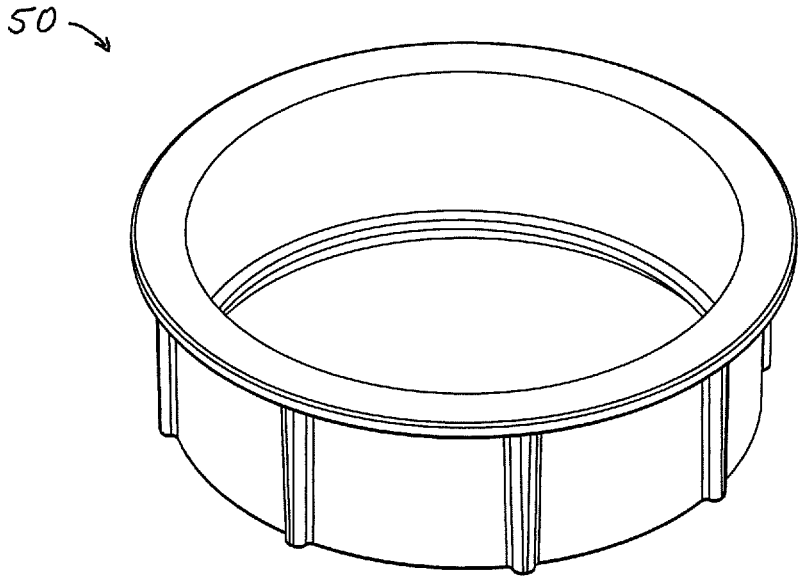

ROTATABLE POWER CENTER FOR A WORK SURFACE

CROSS REFERENCE TO RELATED APPLICATION

The present application claims the benefit of U.S. provisional application Ser. No. 61/980,041, filed Apr. 15, 2014, which is hereby incorporated by reference in its entirety.

FIELD OF THE INVENTION

The present invention relates to electrical power and/or data outlets or receptacles and, more particularly, to devices housing electrical outlets and receptacles for making them accessible at or along a work surface, such as a table or desk.

BACKGROUND OF THE INVENTION

Electrical power outlets and/or electronic data outlets are commonly provided at work surfaces for use by persons located at or near the work surface. In some cases, it is desirable to provide selective access to electrical and/or data outlets so that users have the option of limiting or preclude access to the outlets, such as when the outlets are not needed, or for aesthetic reasons.

SUMMARY OF THE INVENTION

The present invention provides a rotatable power center for a work surface, that is repositionable between a use position in which electrical and/or data outlets are accessible at, along, or near the work surface, and a non-use position in which the outlets are not accessible. In this way, users of the work surface can determine whether their particular needs would be better served by having access to the outlets, or by repositioning the power center to block that access and, optionally, to instead expose a smooth surface or other surface that does not include such outlets. The power center is readily repositioned by releasing a latch or catch and rotating the power center to the desired orientation, whereupon another latch or catch may engage and inhibit further rotation until later being manually released.

According to one form of the present invention, a rotatable power center for a work surface includes a stationary outer housing, a rotatable inner housing, and at least one electrical or data receptacle. The stationary outer housing is mountable at an opening formed in a work surface, and defines an upper opening with a pair of pivot elements disposed on opposite sides of the outer housing. The rotatable inner housing is coupled to the outer housing and is alternately positionable between a use position and a non-use position. The inner housing includes a first inner housing portion having a first surface that is located in the upper opening of the outer housing when the inner housing is in the use position. The inner housing further includes a second inner housing portion having a second surface that is located in the upper opening of the outer housing when the inner housing is in the non-use position. The electrical or data receptacle is mounted in the rotatable inner housing and has a receptacle opening that is generally accessible at or near the first surface of the inner housing. The first inner housing portion has a pair of mounting element portions that cooperate with another pair of mounting element portions of the second inner housing portion to form a pair of mounting elements on opposite sides of the inner housing when the first and second inner housing portions are assembled together. A spindle cap is disposed over each of the mounting elements to thereby secure the first and second pairs of mounting element portions together, which also secures the first and second inner housing portions together. When the spindle caps cover and secure the respective mounting elements of the inner housing, the spindle caps engage respective ones of the pivot elements of the outer housing. The rotatable inner housing is rotatably supported by the outer housing via engagement of the spindle caps with the pivot elements.

According to one aspect, a latch release at each of the first and second surfaces is operable to secure the inner housing at the use position or the non-use position.

According to another form of the present invention, rotatable power center includes an outer housing with a pivot element and a detent-engaging element, and a pivotable inner housing that is supported at the pivot and detent-engaging elements. The outer housing is configured for mounting to a work surface, and has an upper opening and a sidewall that extends downwardly below the upper opening. The pivot and detent-engaging elements are each disposed along the sidewall of the outer housing. The pivotable inner housing is coupled to the outer housing and is alternately positionable between a use position and a non-use position. The inner housing has first and second surfaces, the first being configured to support an electrical or electronic data outlet and positioned in the upper opening when the inner housing is in the use position. The second surface is positioned in the upper opening when the inner housing is in the non-use position. The mounting element is positioned along a side of the inner housing. A spindle or spindle cap is provided at the inner housing and is configured to engage the pivot element. The spindle or spindle cap includes a detent element that is configured to be engaged by the detent-engaging element when the pivotable inner housing is at the use position or the non-use position. The rotatable inner housing is pivotably supported by the outer housing via engagement of the spindle or spindle cap with the pivot element.

Thus, the rotatable power center of the present invention is rotatably or pivotably positionable between a use position in which one or more electrical or data outlets are accessible along a work surface, and a non-use position in which the electrical or data outlets are not accessible. When the electrical or data outlets are not made accessible at the work surface, the rotatable power center may provide a generally planar surface that lacks outlets and/or other features.

These and other objects, advantages, purposes and features of the present invention will become apparent upon review of the following specification in conjunction with the drawings.

BRIEF DESCRIPTION OF THE DRAWINGS

FIG. 1 is a top perspective view of a rotatable power center in accordance with the present invention, shown in a non-use position and spaced above a mounting collar;

DESCRIPTION OF THE PREFERRED EMBODIMENTS

Figure 5:
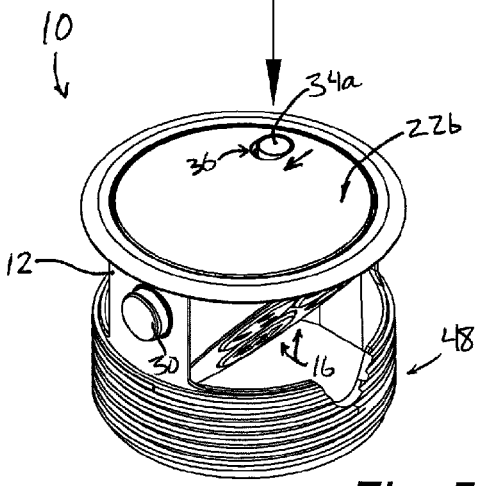
FIG. 5 is another top perspective view of the rotatable power center of FIG. 1, depicting a first step prior to rotating the power center to a use position.
Figure 6:
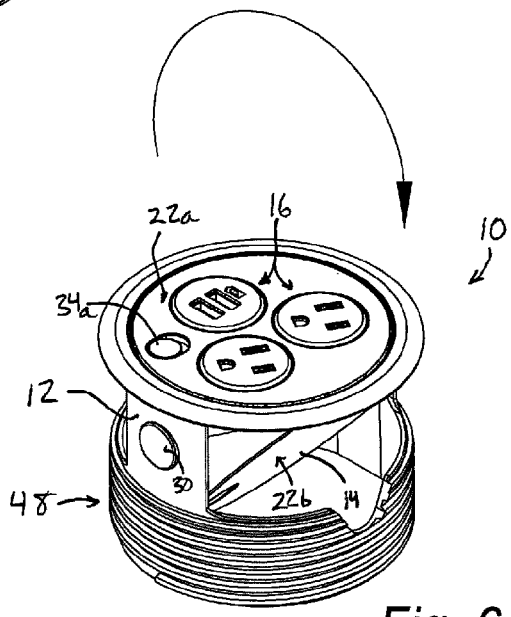
FIG. 6 is another top perspective view of the rotatable power center of FIG. 5, showing the power center after rotating to the use position.
Figure 7:
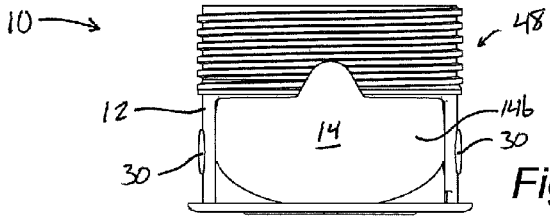
FIG. 7 is an inverted front elevation of the rotatable power center in the use position.
Figure 8:
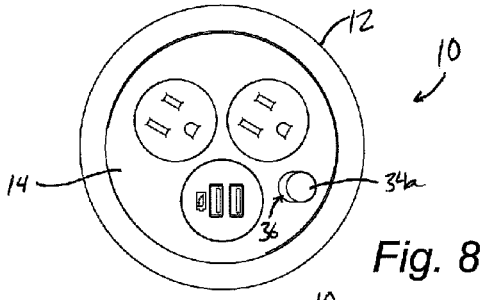
FIG. 8 is top plan view of the rotatable power center of FIG. 7.
Figure 9:
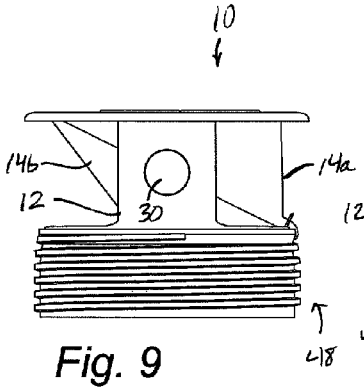
FIG. 9 is a right side elevation of the rotatable power center of FIG. 7.

Referring now to the drawings and the illustrative embodiment depicted therein, a rotatable power center 10 (FIGS. 1-3 and 5-17) is configured for mounting to a work surface such as a table, desk, wall, or the like. Power center 10 includes a stationary outer housing 12, a rotatable inner housing 14, and at least one electrical or data receptacle 16. The stationary outer housing 12 is mountable at an opening formed in a work surface, and defines an upper opening 18 and also a pair of pivot elements in the form of holes 20 (FIGS. 1, 16, and 17) that are disposed on opposite sides of the outer housing 12. The rotatable inner housing 14 is coupled to the outer housing 12 and is alternately positionable between a use position (FIGS. 2, 3, and 6-15) and a non-use position (FIGS. 1 and 5).

Figure 16:
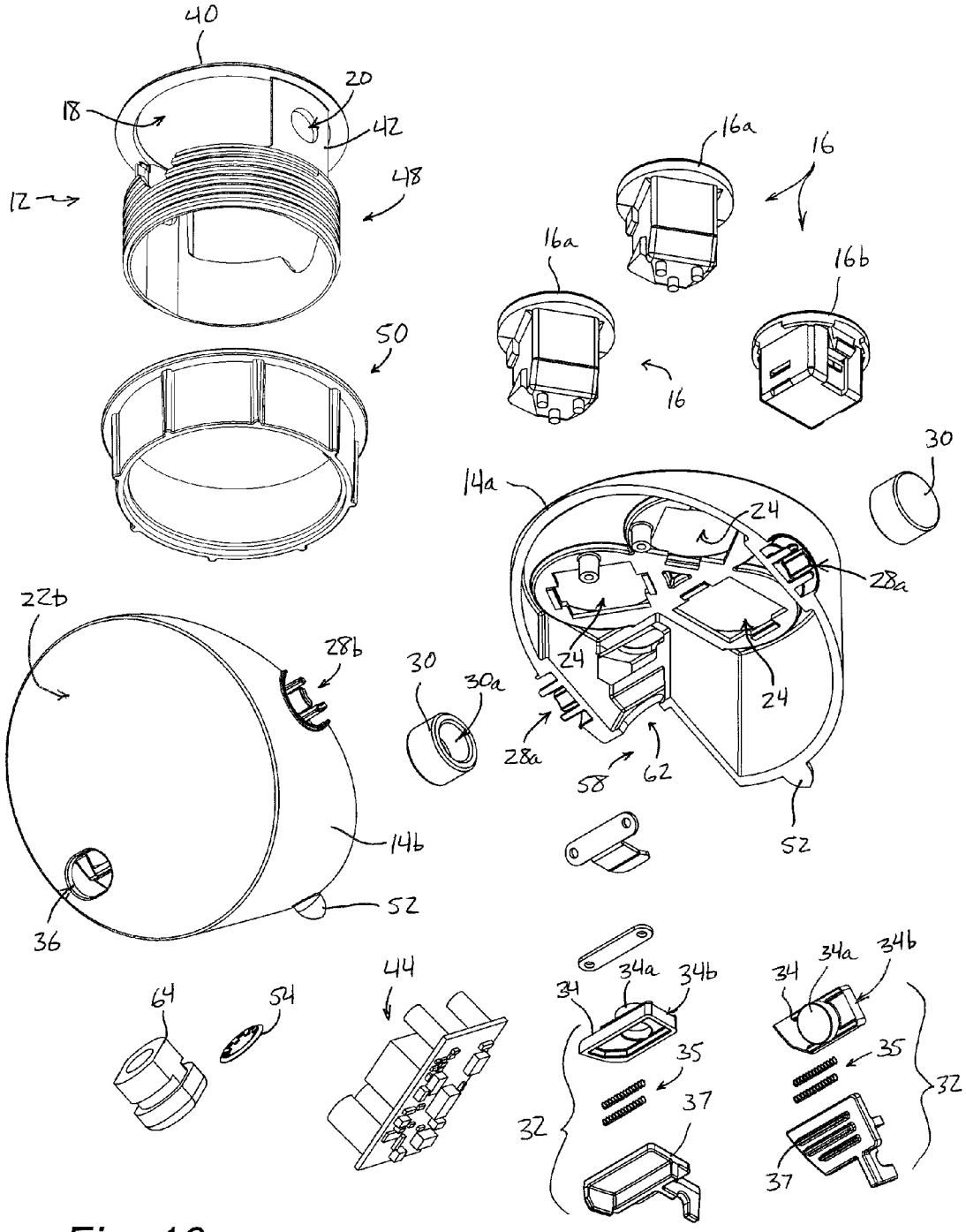
FIG. 16 is an exploded bottom perspective view of the rotatable power center.
Figure 17:
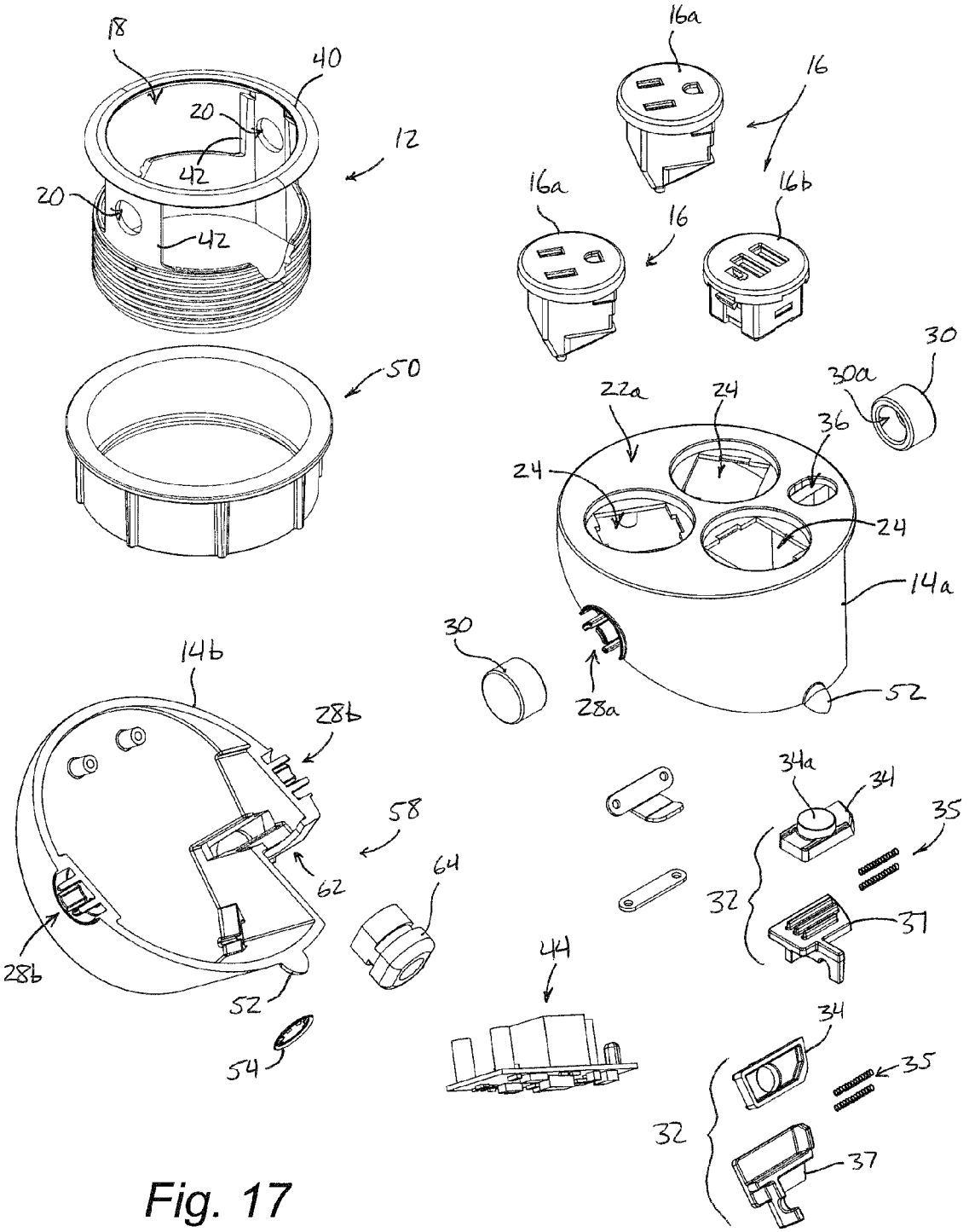
FIG. 17 is an exploded top perspective view of the rotatable power center.
Figure 18:
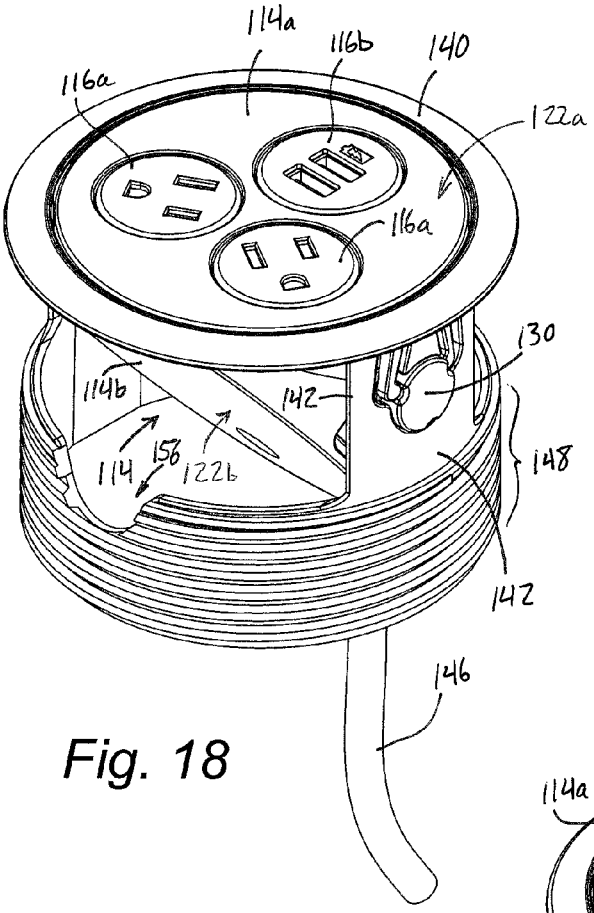
FIG. 18 is a top perspective view of another rotatable power center in accordance with the present invention, shown in a use position and taken from a front-left side thereof.
Figure 19:
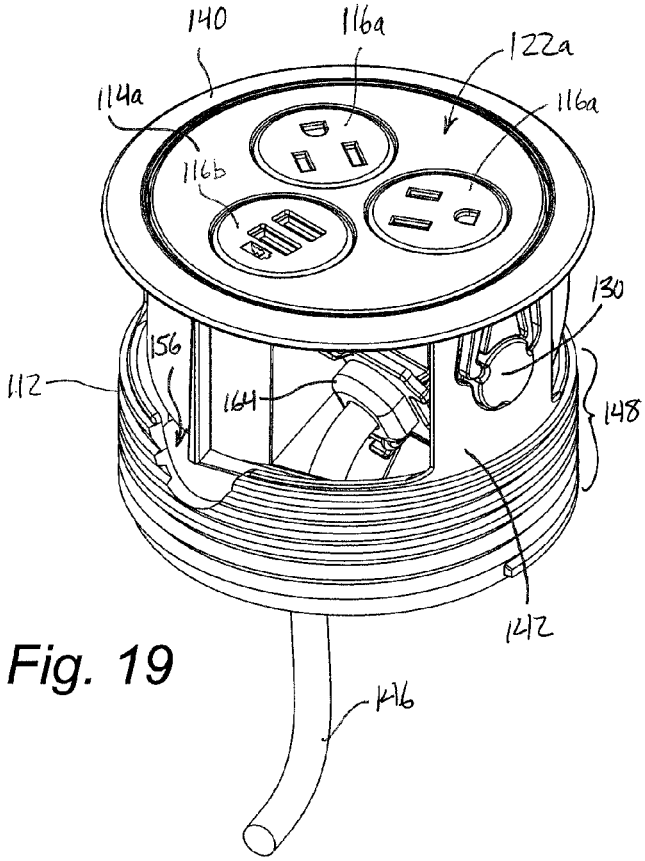
FIG. 19 is another top perspective view of the rotatable power center of FIG. 18, taken from a front-right side thereof.
Figure 20:
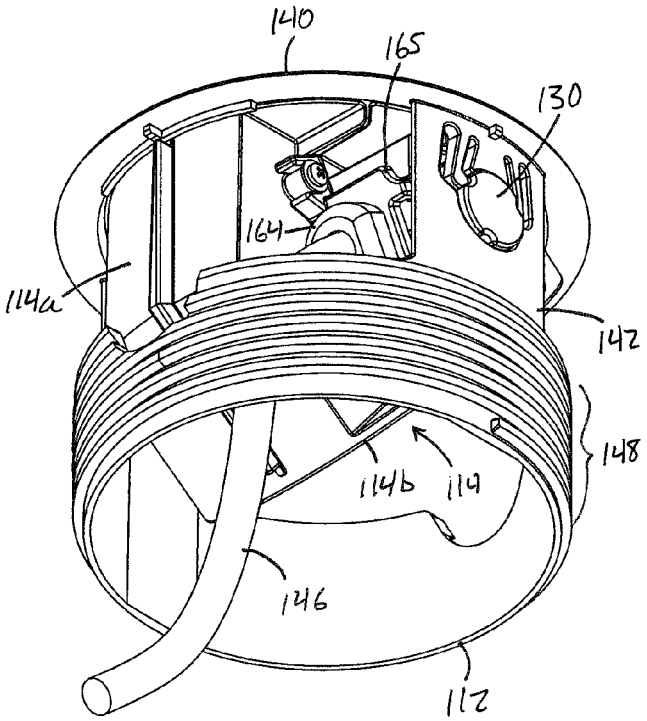
FIG. 20 is a bottom perspective view of the rotatable power center of FIG. 18, taken from the right side thereof.
Figure 21:
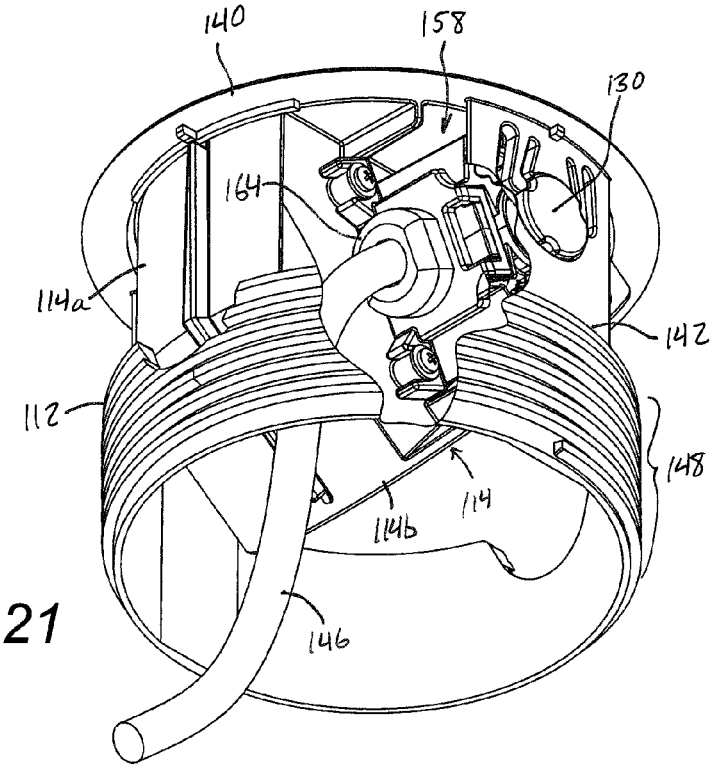
FIG. 21 is another bottom perspective view of the rotatable power center of FIG. 20, with an outer portion cut away to show internal structure.

Inner housing 14 includes a first inner housing portion 14*a* having a first surface 22*a* that is located in the upper opening 18 of the outer housing 12 when the inner housing 14 is in the use position of FIGS. 2, 3 and 6-15. The inner housing 14 further includes a second inner housing portion 14*b* having a second surface 22*b* that is located in the upper opening 18 of the outer housing 12 when the inner housing 14 is in the non-use position of FIGS. 1 and 5. The electrical or data receptacles 16 are mounted in the rotatable inner housing 14, and in the illustrated embodiment, are mounted in respective openings 24 formed or established in first surface 22*a* of first inner housing portion 14*a* (FIGS. 16 and 17). Each receptacle 16 defines at least one receptacle opening 26 (FIG. 13) through which electrical contacts are made accessible to a plug (not shown) such as would be associated with an electrical consumer or an electronic data device.

As shown in FIGS. 16 and 17, the first inner housing portion 14*a* has a pair of mounting element portions generally in the form of half-cylinders 28*a* made up of a plurality of fingers or projections generally arranged in a half-cylinder shape (shown), or that may be solid half-cylinders. Half-cylinders 28*a* cooperate with another pair of mounting element portions in the form of half-cylinders 28*b*, of the second inner housing portion 14*b*, to form a pair of mounting elements on opposite sides of the inner housing 14 when the first and second inner housing portions 14*a*, 14*b* are assembled together. A spindle cap 30 is disposed over adjacent or mated pairs of the mounting elements 28*a*, 28*b* to thereby secure the first and second pairs of mounting element portions 28*a*, 28*b* together (FIGS. 1-3, 5-7, 9 and 11), which in turn also secures the first and second inner housing portions 14*a*, 14*b* together. When the spindle caps 30 cover and secure the respective mounting elements of the inner housing 14, the spindle 30 caps engage respective ones of the pivot elements (holes 20) of the outer housing 12, such as shown in FIGS. 1-3, 5-7, 9 and 11. The rotatable inner housing 14 is thus rotatably supportable by the outer housing 12 via engagement of the spindle caps 30 with the holes 20 formed in sidewalls of outer housing 12. Optionally, a coil spring or other biasing member may be positioned between respective inner surfaces of mounting element portions 28*a*, 28*b* and an interior 30*a* of each spindle cap 30, to bias the spindle caps outwardly into engagement with respective holes 20. Such an arrangement would also facilitate removal of the inner housing 14 from outer housing 12 by permitting spindle caps 30 to be readily depressed inwardly to disengage holes 20.

Figure 3:
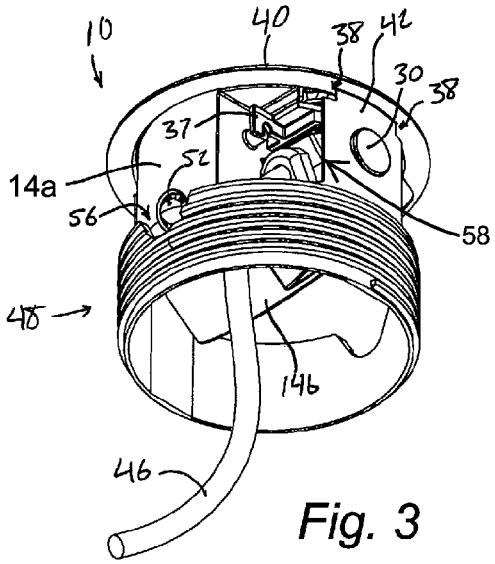
FIG. 3 is a bottom perspective view of the rotatable power center of FIG. 2.
Figure 4:
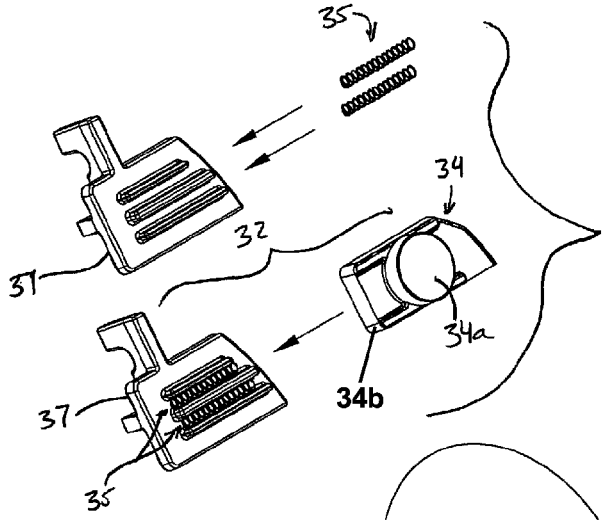
FIG. 4 is an exploded view depicting two assembly steps of a latch mechanism of the rotatable power center.
Figure 14:
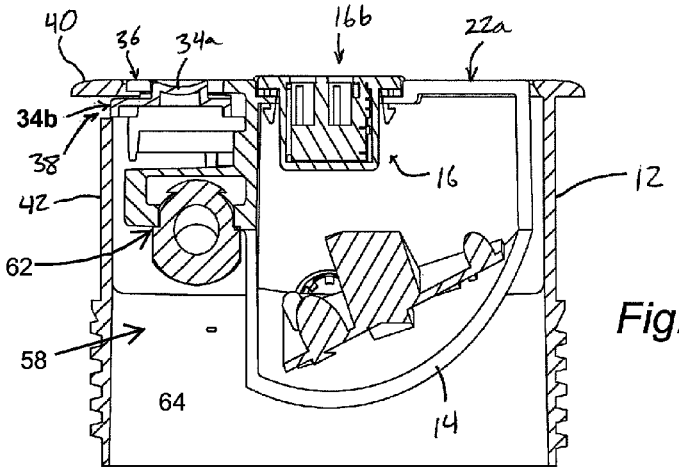
FIG. 14 is a side sectional elevation taken along section line XIV-XIV in FIG. 13.
Figure 15:
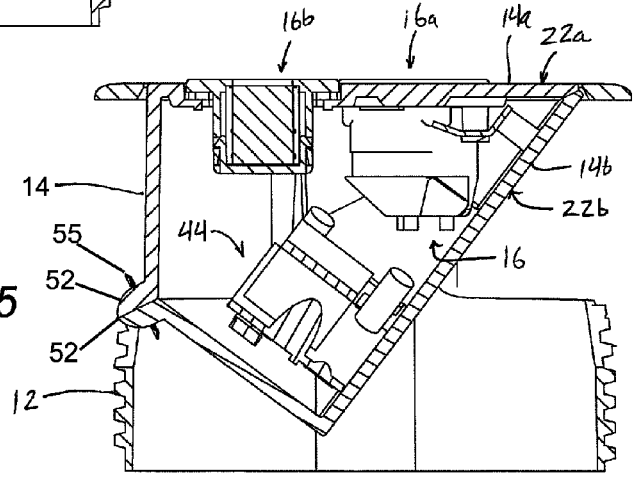
FIG. 15 is a side sectional elevation taken along section line XV-XV in FIG. 13.

Each of the first and second inner housing portions 14*a*, 14*b* includes a respective latch release mechanism 32 (FIGS. 4, 16 and 17) disposed in respective ones of the first surface 22*a* and the second surface 22*b*. Each latch release mechanism 32 includes a movable latch member 34 with a thumb-release 34*a* that is received in one of oblong slots 36, which are formed in respective ones of the first and second surfaces 22*a*, 22*b*. Distal or base portions 34*b* of the latch members 34 are received in a latch opening 38 (FIGS. 3 and 14) that is defined between an upper flange or bezel 40 and a sidewall 42 of the outer housing 12. Latch members 34 are spring-biased toward the engaging position (shown) by springs 35 arranged along a latch slider 37 (FIGS. 4, 16 and 17). The latch member 34 associated with whichever surface 22*a* or 22*b* is positioned in upper opening 18 is operable to secure the inner housing 14 in the use position or the non-use position by engaging an underside of upper flange 40, such as shown in FIG. 14.

Figure 2:
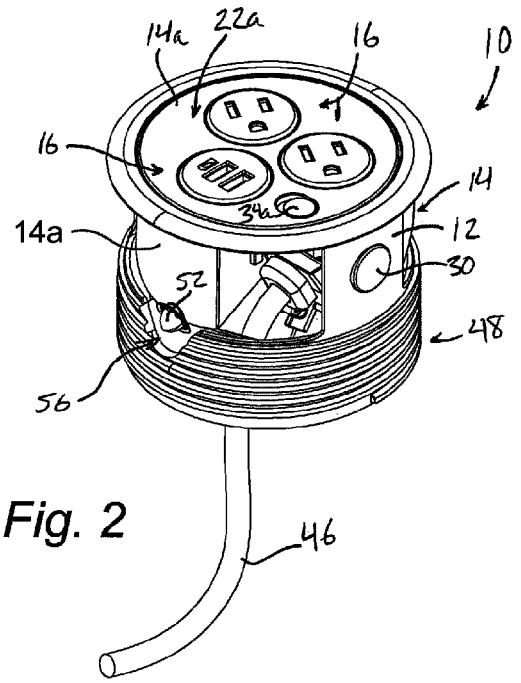
FIG. 2 is another top perspective view of the rotatable power center of FIG. 1, shown in a use position and with a power supply cord attached thereto.

Optionally, the receptacles 16 include high voltage AC power receptacles 16*a*, such as 110V or 220V receptacles, and low voltage DC power receptacles 16*b*, such as 5V to 12V DC power receptacles including USB-style receptacles 16*b* (FIGS. 13-15 and 17). When low voltage DC power receptacles 16*b* are provided, the inner housing 14 may include an electrical transformer 44 (FIGS. 15-17) that is operable to receive high voltage AC power from a power input (e.g. an AC power cord 46, as shown in FIGS. 2 and 3) and that directs low voltage DC power to the low voltage DC electrical receptacle 16*b*.

Upper flange 40 of outer housing 12 defines the upper opening 18, and is configured to rest atop or along a work surface such as a table or desk, although it is envisioned that rotatable power center 10 could also be mounted in substantially any opening formed in a partition wall, a solid or raised floor, a ceiling, or the like, without departing from the spirit and scope of the present invention. Sidewalls 42 are partial-cylindrical in shape and extend downwardly from the upper flange 40. Sidewalls 42 are configured to extend at least partially into an opening formed in the work surface. The sidewalls 42 extend down to a threaded generally cylindrical lower portion 48 that is configured to receive a threaded collar 50 (FIGS. 1, 16 and 17) for securing the outer housing 12 to the work surface at the opening formed in the work surface.

Referring to FIGS. 1 and 5, second surface 22*b* of the inner housing's second portion 14*b* is substantially planar and substantially precludes access to the electrical outlets 16 when the inner housing is in the non-use position. Optionally, second surface 22*b* may be marked with indicia, or may be partially or substantially made up of a soft surface such as felt, cork, rubber, or the like.

Figure 10:
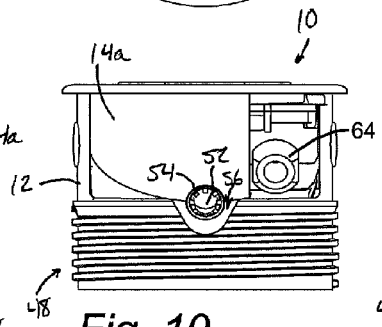
FIG. 10 is an rear elevation of the rotatable power center of FIG. 7.
Figure 11:
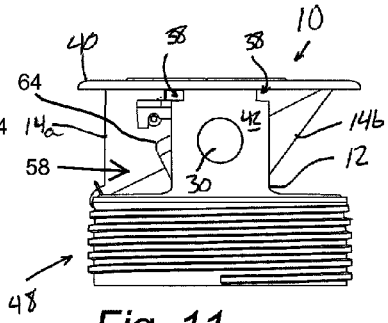
FIG. 11 is left side elevation of the rotatable power center of FIG. 7.
Figure 12:
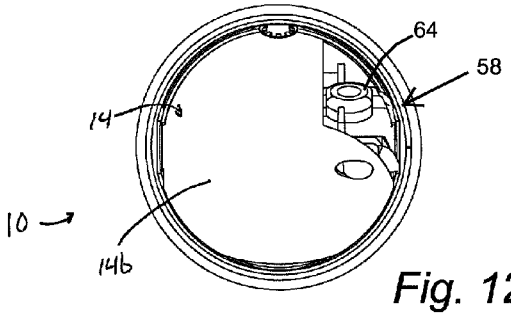
FIG. 12 is bottom plan view of the rotatable power center of FIG. 7.
Figure 13:
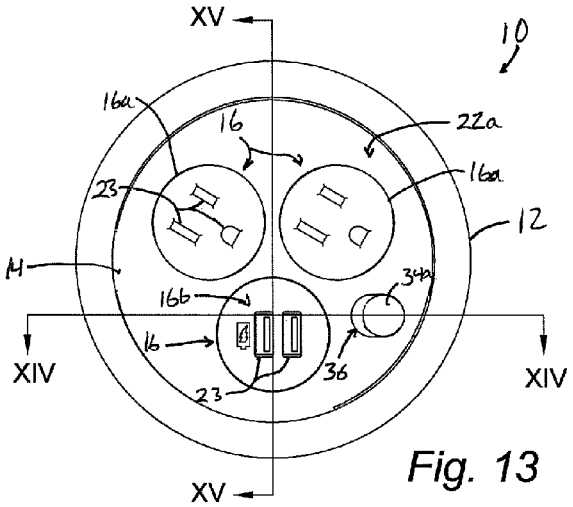
FIG. 13 is another top plan view of the rotatable power center of FIG. 7.

The first inner housing portion 14*a* and the second inner housing portion 14*b* define respective projection halves 52 that are aligned when the inner housing portions 14*a*, 14*b* are aligned (FIGS. 2, 3, 10 and 15), and which are configured to receive a securing collar 54 to further secure the housing portions 14*a*, 14*b* together, in cooperation with spindle caps 30. Projection halves 52 are received in a recess region 56 formed in cylindrical lower portion 48 of outer housing 12 when inner housing 14 is in the use position, such as shown in FIGS. 2, 3 and 10. Projection halves 52 may also serve to limit or prevent inner housing from rotating to a position that would expose surfaces of the inner housing 14 other than the first and second surfaces 22*a*, 22*b*, including an area 58 where a power cord 46 exits through an opening 62 fitted with a rubber strain relief 64, such as shown in FIGS. 3, 10-12, 14, 16 and 17.

Figure 22:
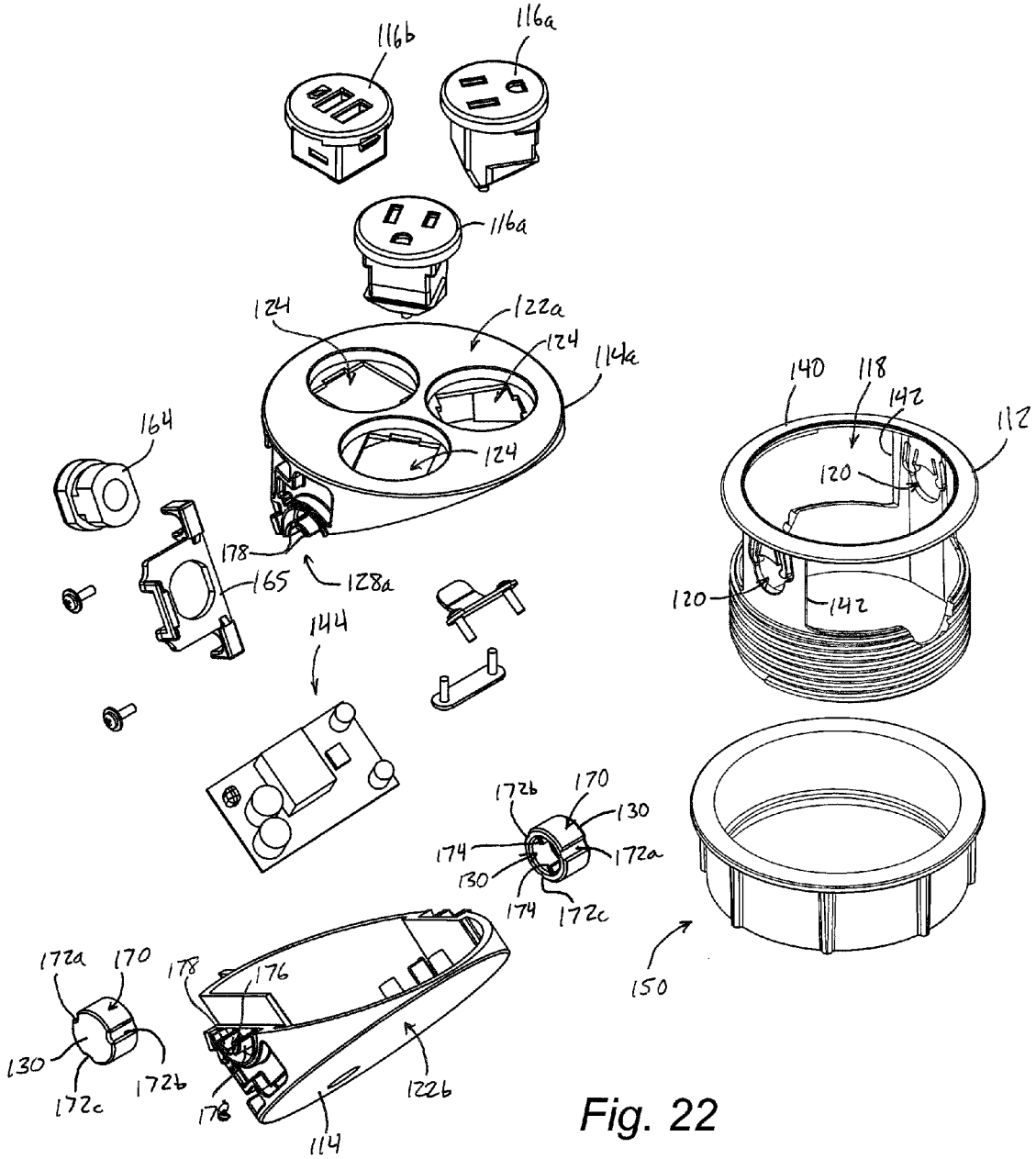
FIG. 22 is an exploded top perspective view of the rotatable power center of FIG. 18.
Figure 23:
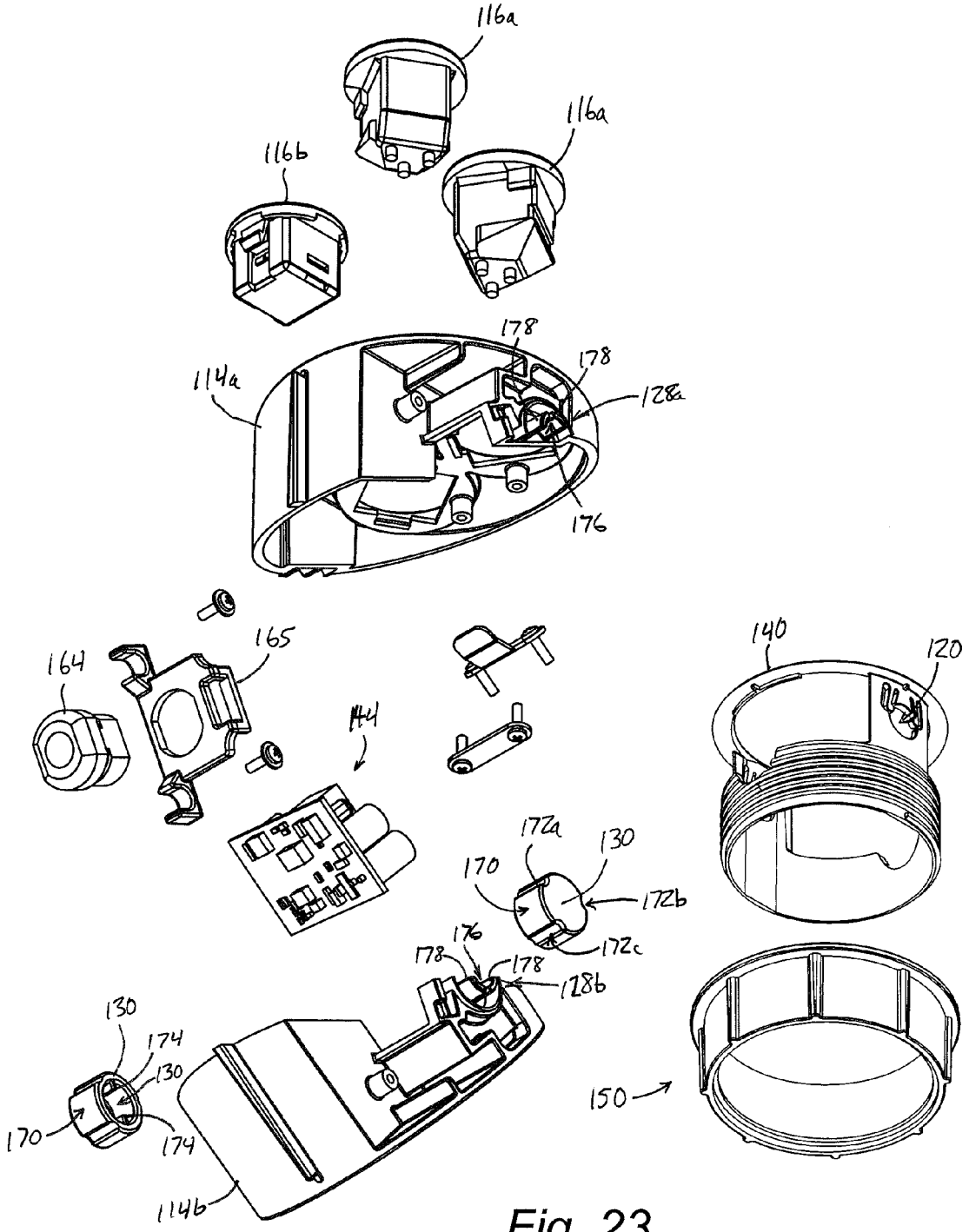
FIG. 23 is an exploded bottom perspective view of the rotatable power center of FIG. 18.

Optionally, and with reference to FIGS. 18-31, another rotatable power center 110 includes a stationary outer housing 112 and a rotatable or pivotable inner housing 114 including a first inner housing portion 114*a* and a second inner housing portion 14*b* (FIGS. 22 and 23). Various components and surfaces of power center 110 that are substantially similar or generally correspond to components and surfaces of power center 10 are given like numerals by the addition of 100, such that the components and surfaces of power center 110 may be understood with reference to the above discussion, with the following description addressing only the main differing features of power center 110. Minor differences include, for example, the use of a separate strain relief mount 165 that secures strain relief 164 to second inner housing portion 114*b*. Outer housing 112 includes an upper flange or bezel 140 and a generally cylindrical threaded lower portion 148 that are substantially the same or identical to the corresponding components of power center 10, but with a pair of sidewalls 142 that differ in the shape and configuration of pivot elements 120 as compared to pivot elements 20.

Figure 24A:
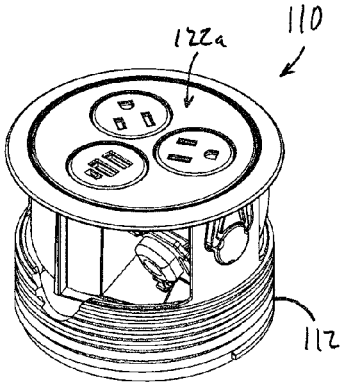
FIGS. 24A, 25A and 26A are top perspective views of the rotatable power center of FIG. 18, depicting three rotational positions from use position to non-use position.
Figure 24B:
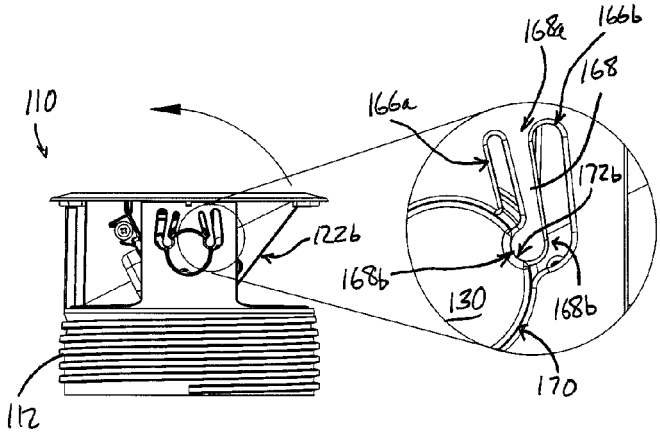
FIGS. 24B, 25B and 26B are side elevations, including enlarged regions to show detail, generally corresponding to FIGS. 24A, 25A and 26A, respectively.
Figure 25A:
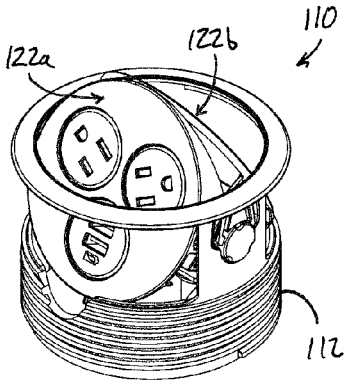
Figure 25B:
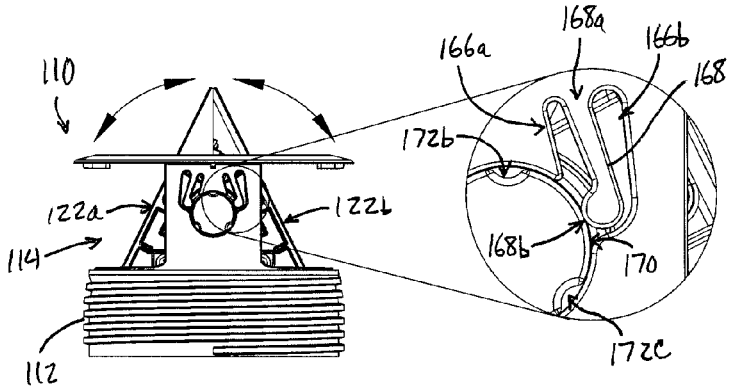
Figure 26A:
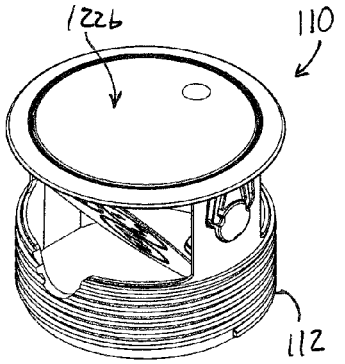
Figure 26B:
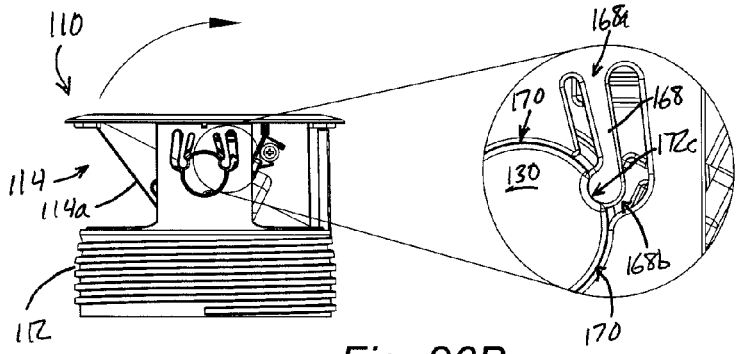
Figure 27:
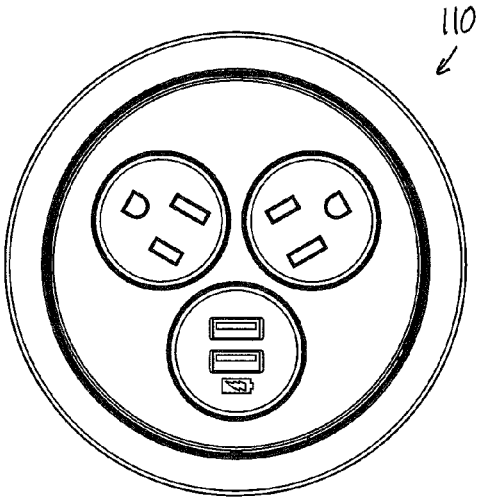
FIG. 27 is a top plan view of the rotatable power center of FIG. 18.
Figure 28:
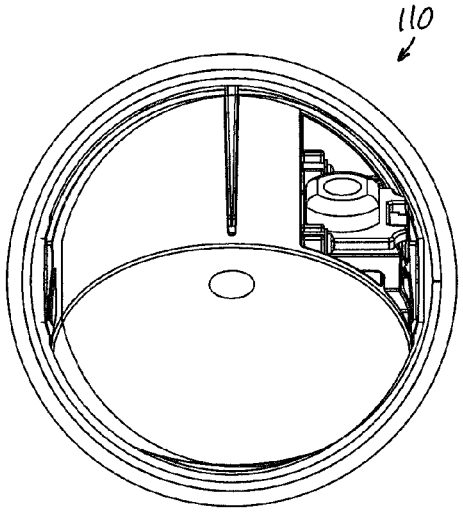
FIG. 28 is a bottom plan view of the rotatable power center.
Figure 29:
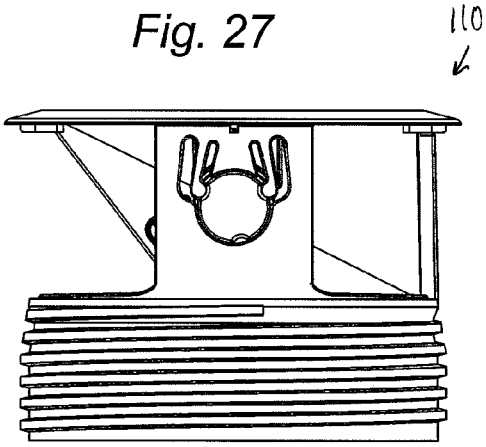
FIG. 29 is a left side elevation of the rotatable power center.
Figure 30:
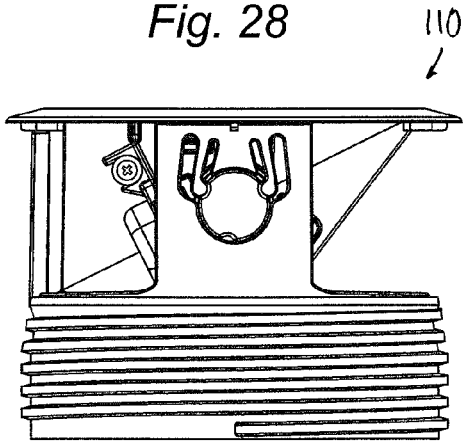
FIG. 30 is a right side elevation of the rotatable power center.
Figure 31:
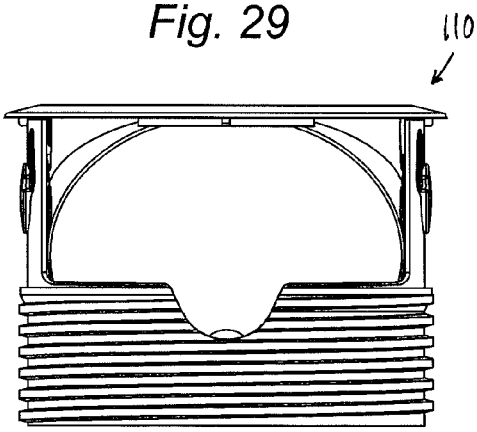
FIG. 31 is a front elevation of the rotatable power center.
Figure 32:
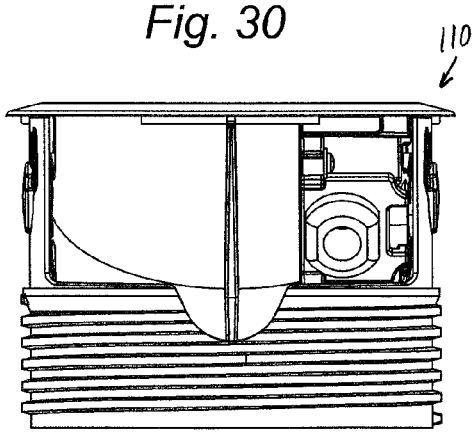
FIG. 32 is a rear elevation of the rotatable power center.

Pivot elements 120 are formed as generally circular holes for receiving respective spindle caps 130, but each hole has two pairs of slots, including inboard slots 166*a* and outboard slots 166*b*, extending generally upwardly toward upper flange 140 such as shown in FIGS. 18-21, 24B, 25B, 26B, 29 and 30. As best shown in FIGS. 24B, 25B, 26B, a detent-engaging element in the form of a resilient projection 168 is defined between each adjacent pair of slots 166*a*, 166*b*. Projection 168 has a base or proximal region 168*a* near upper flange 140, and a distal free tip portion 168*b* that is biased inwardly toward and into pivot element or opening 120, so that tip portions 168*b* engage an outer surface 170 of spindle cap 130 when the spindle cap is inserted into opening 120.

The spindle cap's outer surface 170 includes or defines three detents 172*a-c* that are grooves or depressions oriented longitudinally and evenly spaced circumferentially apart from one another around outer surface 170 (FIGS. 20-23). With three detents 172*a-c* it will be appreciated that even spacing yields approximately 120-degree spacing of each detent from the adjacent detents. In the illustrated embodiment, the two detent-engaging projections 168 corresponding to each pivot element opening 120 are aligned so that their tip portions 168*b* are spaced circumferentially apart by approximately 120-degrees along pivot element opening 120. This allows the two tip portions 168*b* to engage respective ones of the three detents 172*a-c* when inner housing 114 is in the use position of FIGS. 18-21, 24A, 24B, and 27-32 (where a first detent 172*a* and a second detent 172*b* are so engaged), and also when the inner housing 114 is in the non-use position of FIGS. 26A and 26B (where second detent 172*b* and a third detent 172*c* are so engaged).

Accordingly, two tip portions 168*b* engage two of detents 172*a-c* to retain inner housing 114 in either of the use position or the non-use position. The tip portions 168*b* disengage their respective detents 172*a-c* when sufficient force is applied by a user to first surface 122*a* or second surface 122*b* (whichever is exposed at upper opening 118) to overcome the retention force of tip portions 168*b* acting on the engaged detents. When sufficient force is applied, such as shown in FIGS. 24A-26B, tip portions 168*b* slide along outer surface 170 of the spindle cap 130 (FIGS. 25A and 25B) until the next detents 172*a-c* are engaged (FIGS. 26A and 26B). Spindle caps 130 have interiors 130*a* in which two radial walls 174 extend inwardly from opposite directions to engage respective slots 176 defined between adjacent fingers or projections 178 of half-cylindrical mounting elements 128*a*, 128*b* (FIGS. 22 and 23). This engagement allows spindle caps 130 to turn with inner housing 114 relative to outer housing 112 and projections 168.

Although spindle caps 30, 130 are shown as separate elements from inner housing 114, it will be appreciated that an inner housing may be used which incorporates spindles that serve a similar function of pivotably coupling the inner housing to the outer housing 112, particularly if the spindles are not also used to secure two inner housing portions together. For example, such spindles could be integrally or unitarily formed with an inner housing or inner housing portion. It will further be appreciated that, when a detent arrangement is used such as described above, detents and detent-engaging elements or surfaces may be formed in any desired number and in different locations and/or spacing, including inside of spindle caps or the like. It is also envisioned that a single spindle or spindle cap could be used to secure a pivotable or rotatable inner housing to an outer housing, without need for a second spindle or spindle cap on the other side, provided that the single pivot is structurally designed to handle increased bending moments that would be inherent with a single-side mounting arrangement.

Accordingly, the rotatable power and/or data center of the present invention provides selective access to electrical and/or data outlets at, along, or near are work surface and, in the illustrated embodiments, is adapted for installation at an opening formed or established in a work surface, wall, floor, ceiling, or the like. In this way, users of the work surface can choose whether to have access to the outlets, or whether to rotate the center so that only a non-electrical surface is visible along the work surface. The power center is readily repositioned by releasing a latch or catch, or by overcoming a detent feature by the application of sufficient force in a desired direction, and rotating the power center to the desired orientation.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A rotatable power center for a work surface, said power center comprising:

an outer housing configured for mounting to a work surface, said outer housing defining an upper opening and comprising at least one pivot element disposed along a side of said outer housing;

a pivotable inner housing coupled to said outer housing and alternately positionable between a use position and a non-use position, said inner housing comprising first and second inner housing portions;

said first inner housing portion having a first surface that is positioned in said upper opening of said outer housing when said inner housing is in said use position, wherein said first surface is configured to support at least one electrical or data receptacle;

said second inner housing portion having a second surface that is positioned in said upper opening of said outer housing when said inner housing is in said non-use position;

said first inner housing portion comprising a first mounting element portion and said second inner housing portion comprising a second mounting element portion, wherein said first and second mounting element portions cooperate to form a mounting element along a side of said inner housing when said first and second inner housing portions are assembled together; and a spindle cap disposed over said mounting element, said spindle cap configured to secure said first and second mounting element portions together to thereby secure said first and second inner housing portions together;

wherein said rotatable inner housing is pivotably supported by said outer housing via engagement of said spindle cap with said pivot element.

2. The rotatable power center of claim 1, wherein each of said first and second mounting element portions is half cylindrical in shape.

3. The rotatable power center of claim 1, wherein each of said first and second mounting element portions comprises two or more projections in a half-cylindrical arrangement.

4. The rotatable power center of claim 1, further comprising a latch release disposed in each of said first surface and said second surface, wherein distal portions of said latch releases are receivable in a latch opening defined by said outer housing and are operable to selectively secure said inner housing in one of said use position and said non-use position.

5. The rotatable power center of claim 1, further comprising at least one electrical or data receptacle mounted in an opening formed in said first surface, wherein said at least one electrical or data receptacle comprises a receptacle opening accessible at said first surface.

6. The rotatable power center of claim 5, wherein said at least one electrical or data receptacle comprises a low voltage DC electrical receptacle.

7. The rotatable power center of claim 6, further comprising an electrical transformer disposed in said inner housing, wherein said electrical transformer is configured to receive high voltage AC power from a power input and to direct low voltage DC power to said low voltage DC electrical receptacle.

8. The rotatable power center of claim 7, wherein said at least one electrical or data receptacle further comprises a high voltage AC electrical receptacle configured to receive the high voltage AC power from the power input.

9. The rotatable power center of claim 1, wherein said outer housing comprises an upper flange that defines said upper opening and is configured to rest atop the work surface, and wherein said sidewall extends downwardly from said upper flange and is configured to extend into an opening formed in the work surface.

10. The rotatable power center of claim 9, wherein said sidewall comprises a threaded lower portion configured to extend fully through the work surface and to receive a threaded collar for securing said outer housing to the work surface at the opening formed therein.

11. The rotatable power center of claim 1, wherein said spindle cap is configured to rotate with said inner housing relative to said outer housing, wherein said spindle cap comprises a detent element and said outer housing comprises a detent-engaging element configured to selectively engage said detent element when said pivotable inner housing is at one of said use position and a non-use position.

12. The rotatable power center of claim 11, wherein said detent element comprises a depression formed in an outer circumferential surface of said spindle cap, and said detent-engaging element comprises a projection that is selectively received in said depression.

13. The rotatable power center of claim 12, wherein said projection comprises a resilient member having a free tip portion for engaging said depression.

14. The rotatable power center of claim 12, wherein said spindle cap comprises at least two of said depressions in circumferentially spaced arrangement, wherein a first of said depressions is engaged by said detent-engaging element in said use position and a second of said depressions is engaged by said detent-engaging element in said non-use position.

15. The rotatable power center of claim 14, wherein said spindle cap comprises three of said depressions circumferentially spaced evenly apart from one another, wherein said detent-engaging element comprises two of said projections, and wherein said projections each engage respective ones of said depressions in each of said use position and said non-use position.

16. The rotatable power center of claim 1, comprising a pair of said pivot elements arranged on opposite sides of said outer housing, and a pair of said spindle caps configured to engage respective ones of said pivot elements, wherein said first inner housing portion comprises a pair of first mounting element portions and said second inner housing portion comprises a pair of said second mounting element portions, wherein said first mounting element portions cooperate with said second mounting element portions to form a pair of said mounting elements at opposite sides of said inner housing when said first and second inner housing portions are assembled together.

17. The rotatable power center of claim 16, wherein said first and second inner housing portions comprise respective projections extending outwardly from outer surfaces of said housing portions between said mounting elements, and wherein a securing collar is disposed around said projections to secure said projections together, whereby said first and second inner housing portions are coupled together by said spindle caps and said securing collar.

18. A rotatable power center for a work surface, said power center comprising:

an outer housing configured for mounting to a work surface, said outer housing defining an upper opening and comprising a sidewall extending downwardly below said upper opening;

a pivot element and a detent-engaging element each disposed along said sidewall;

a pivotable inner housing coupled to said outer housing and alternately positionable between a use position and a non-use position, said inner housing having first and second surfaces, wherein said first surface is configured to support an electrical or electronic data outlet and is positioned in said upper opening when said inner housing is in said use position, and said second surface is positioned in said upper opening when said inner housing is in said non-use position; and a spindle along said inner housing and configured to engage said pivot element, said spindle comprising a detent element configured to be engaged by said detent-engaging element when said pivotable inner housing is at one of said use position and a non-use position;

wherein said rotatable inner housing is pivotably supported by said outer housing via engagement of said spindle with said pivot element.

19. The rotatable power center of claim 18, wherein said spindle comprises three of said detent elements spaced circumferentially apart from one another, and wherein said detent-engaging element comprises a pair of resilient projections with respective tips that are simultaneously received by respective ones of said detent elements when said pivotable inner housing is at either said use position or said non-use position.

20. The rotatable power center of claim 19, wherein:

said pivotable inner housing comprises first and second inner housing portions;

said first inner housing portion includes said first surface and said second inner housing portion includes said second surface;

said first inner housing portion includes a pair of first mounting element portions and said second inner housing portion includes a pair of second mounting element portions;

said first and second mounting element portions cooperate to form a pair of mounting elements at opposite sides of said inner housing when said first and second inner housing portions are assembled together; and said spindle comprises a pair of spindle caps that are disposed over respective ones of said mounting elements to thereby secure respective ones of said first and second mounting element portions together and to thereby secure said first and second inner housing portions together.

* * * * *